US005833551A

United States Patent [19]

Vincent et al.

[11] Patent Number: 5,833,551

[45] Date of Patent: Nov. 10, 1998

[54] IRON GOLF CLUB HEAD

[75] Inventors: Benoit Vincent, Leucadia; Bret Wahl, Carlsbad; Steve Nootens, Vista, all of Calif.

[73] Assignee: Taylor Made Golf Company, Inc., Carlsbad, Calif.

[21] Appl. No.: 787,113

[22] Filed: Jan. 22, 1997

Related U.S. Application Data

[63] Continuation-in-part of Ser. No. 711,267, Sep. 9, 1996.

[60] Provisional application No. 60/023,257, Aug. 9, 1996.

[51] Int. Cl.[6] ..... A63B 53/04

[52] U.S. Cl. ..... 473/350; 473/349

[58] Field of Search ..... 473/349, 350, 473/324

[56] References Cited

U.S. PATENT DOCUMENTS

| | | | |
|---|---|---|---|
| 3,955,820 | 5/1976 | Cochran et al. . | |
| 4,355,808 | 10/1982 | Jernigan et al. | 473/350 X |
| 5,026,056 | 6/1991 | McNally et al. . | |
| 5,094,457 | 3/1992 | Kinoshita . | |
| 5,120,062 | 6/1992 | Scheie et al. | 473/350 X |
| 5,297,794 | 3/1994 | Lu . | |
| 5,335,914 | 8/1994 | Long | 473/350 |
| 5,395,113 | 3/1995 | Antonious . | |
| 5,419,560 | 5/1995 | Bamber | 473/350 |
| 5,429,353 | 7/1995 | Hoeflich . | |
| 5,564,705 | 10/1996 | Kobayashi et al. | 473/349 X |
| 5,584,770 | 12/1996 | Jensen | 473/350 |
| 5,616,088 | 4/1997 | Aizawa et al. | 473/350 X |
| 5,669,825 | 9/1997 | Shira . | |

FOREIGN PATENT DOCUMENTS

| | | | |
|---|---|---|---|
| 6-205859 | 7/1994 | Japan | 273/167 F |
| 2251556 | 7/1992 | United Kingdom | 273/167 R |

*Primary Examiner*—Raleigh W. Chiu
*Attorney, Agent, or Firm*—Greenblum & Bernstein, P.L.C.

[57] ABSTRACT

An iron golf club head provided with a cavity that is open rearwardly and surrounded by a peripheral edge, the head including a body made of a low density metallic material and an attached insert made of material of higher density than the density of the body material. The peripheral edge has a lower portion extending vertically beneath the cavity and extending horizontally from the toe area to the heel area, whereby the insert occupies at least one part of the lower portion and has a generally crescent shape, with a concave upper central portion and raised lateral portions at the heel and at the tip, respectively. In a particular embodiment, the body of the club head is provided with a housing arranged in the sole and extending continuously from the toe area to the heel area, with the insert occupying the housing and being sandwiched between the striking surface and the peripheral edge. In a further embodiment, the housing of the insert is demarcated by a wall of the striking surface and by a rear central edge extending from the edge of the cavity up to the sole and on only a portion of the length of the club head, the housing being open rearwardly and in the direction of the sole in the toe area and heel area, and the housing having a general crescent shape which includes a central notch defining a reduction of the thickness of the flanks, in which the rear central edge of the body takes position. In yet another embodiment, the body includes a recessed area extending from the toe area to the heel area and beneath the open cavity in the direction of the sole, with the insert occupying the recessed area and being fixed by a dovetail- type linkage.

37 Claims, 12 Drawing Sheets

XIV
XII
XIII 800
90
6
80
3
81
710
4
91
700
810 c
810 b
810 a
5
810 d
810
XIV
XII
XIII 90
80
800 b
6
3
91
4
700
710
810 c
810 b
800
800 a

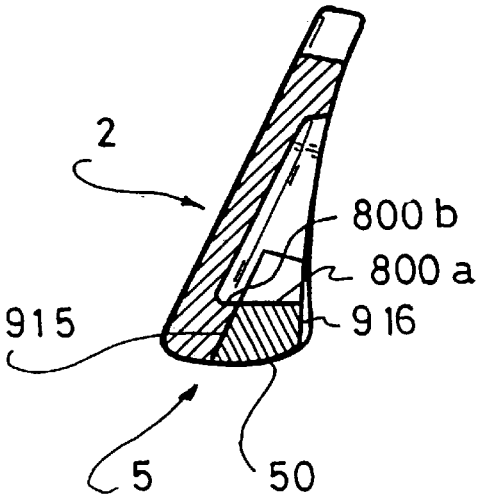
Fig: 12
Fig: 13
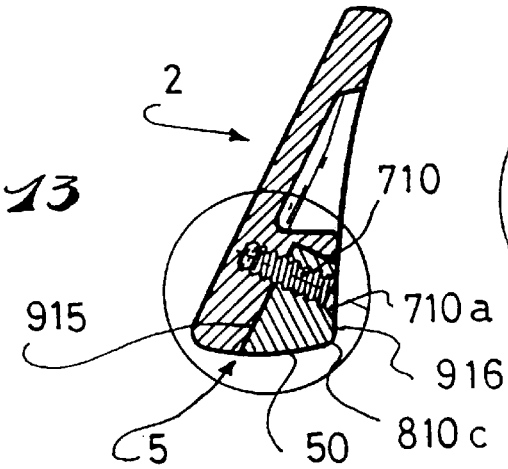
Fig: 13a
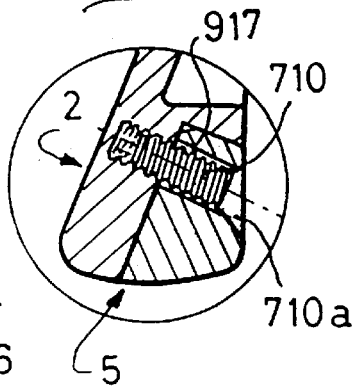
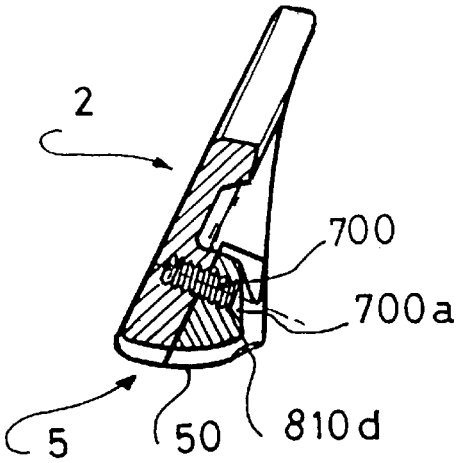
Fig: 14

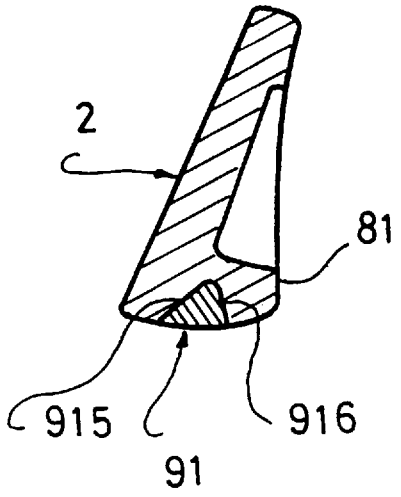
Fig: 20
Fig: 21
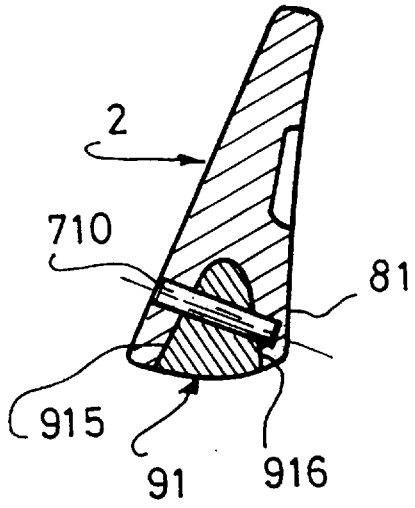
Fig: 22
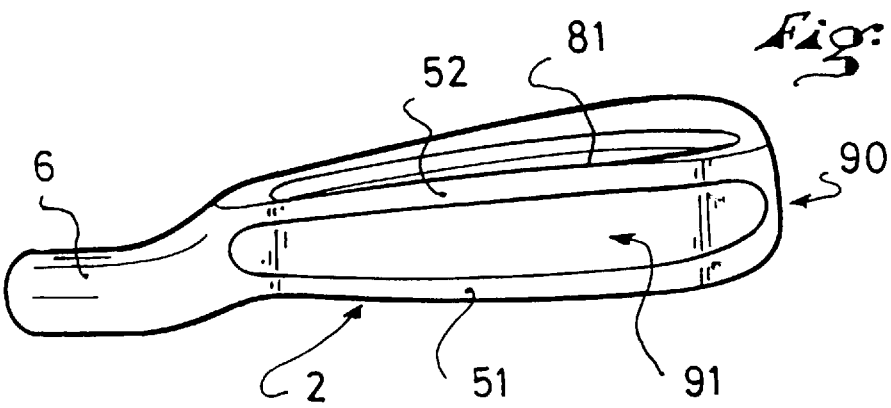

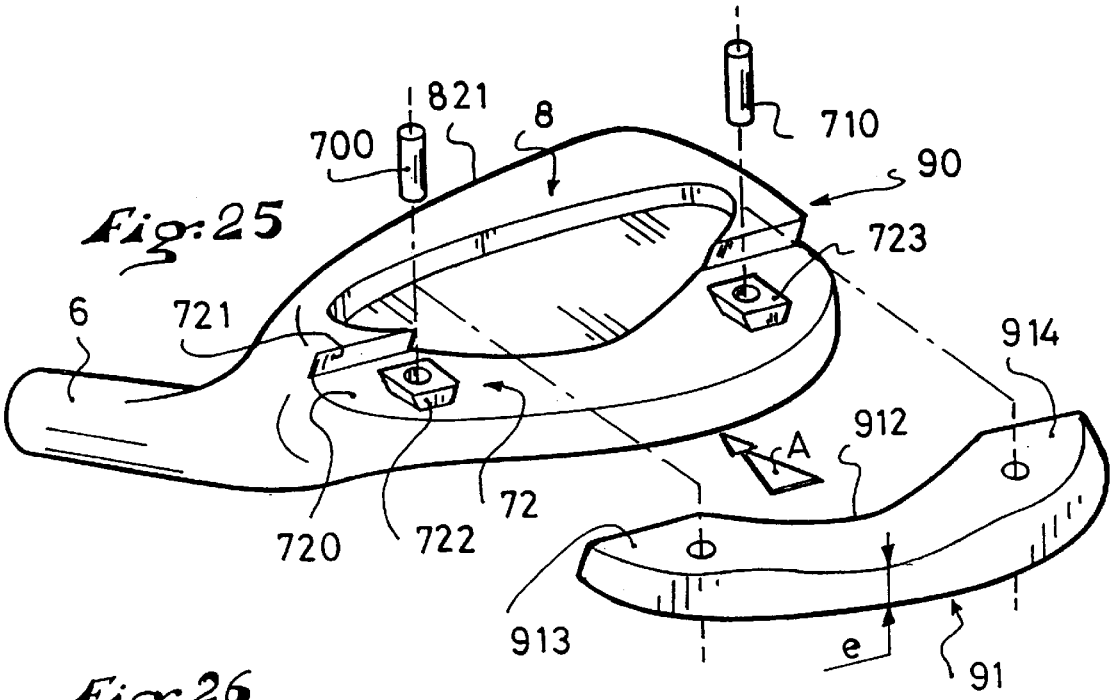
Fig:25
Fig:26
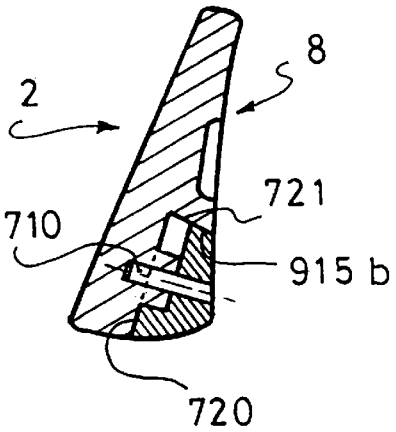
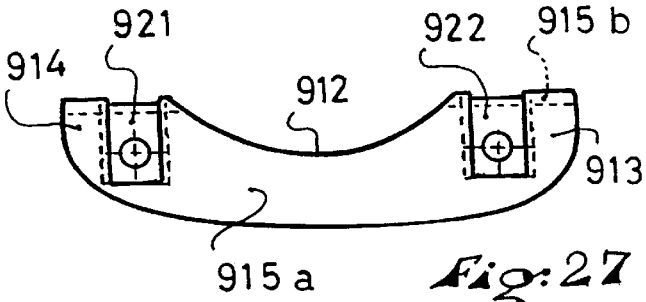
Fig:27
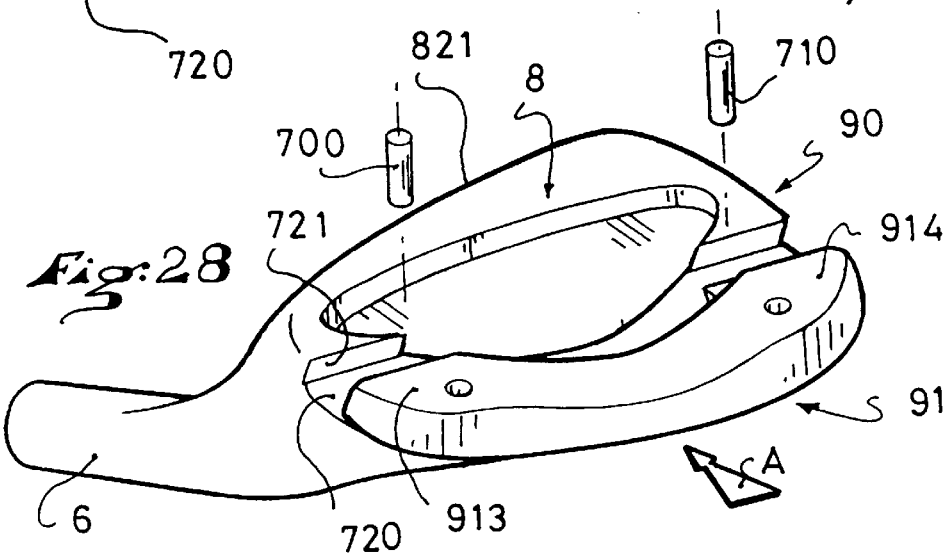
Fig:28

IRON GOLF CLUB HEAD

CROSS-REFERENCE TO RELATED APPLICATIONS

This application is based upon U.S. Provisional Patent Application No. 60/023,257, filed on Aug, 9, 1996, the disclosure of which is hereby incorporated by reference thereto in its entirety and the priority of which is claimed under 35 USC 119.

This application is a continuation-in-part of U.S. patent application Ser. No. 08/711,267, filed on Sep. 9, 1996, the disclosure of which is hereby incorporated by reference thereto in its entirety and the priority of which is claimed under 35 USC 120.

BACKGROUND OF THE INVENTION

1. Field of the Invention

The present invention relates to the field of golf, and is related in particular to an iron golf club head.

2. Description of Background and Related Art

Different categories of iron golf clubs are commercially available. Among them, clubs having a head shaped like a metallic blade are commonly referred to as "blades". These clubs are mainly intended for experienced players and professional players who appreciate the quality of the sensation at impact, in spite of the blade's lack of tolerance during an off-centered stroke. None of these heads achieve high values of inertia "Iy"(those measured around the vertical axis passing through the center of gravity). In particular, the measured values for a 5 iron are very close to or less than 220 Kg.mm$^2$. Such low values lead to a lack of tolerance that may lead to distance and accuracy degradation and in particular a deviation of the ball with respect to the aimed trajectory when the impact occurs in a zone that is laterally offset in relation to the center of the striking face.

There is another category of widely used clubs whose heads are generally made of steel, and which have a rear cavity allowing for a peripheral distribution of the mass around the useful portion of the striking surface that is generally referred to as the sweet spot. These clubs are known as cavity back irons. Most players at any level play with this category of clubs due to their versatility and tolerance to off-centered strokes. In view of the peripheral distribution of the mass, the values of inertia (Iy) are greater than those of the blade-type heads, and are on the order of 220–240 Kg.mm$^2$ for a 5 iron. However, generally in this category, the position of the center of gravity is high with respect to the ball and generally above the theoretical point of impact, which causes a harsh sensation upon impact that is not appreciated by the player. In particular, the vertical height of the center of gravity with respect to the ground varies between approximately 0.75 and 0.85 inches.

Finally, there are various other types of irons, such as clubs whose heads are made out of non-ferrous metallic materials such as titanium. Those that are commercially available reach substantial values of inertia (Iy), on the order of 240–250 Kg.mm$^2$ for a 5 iron, in view of titanium's low density which allows for an enlargement of the head with a total mass equivalent to that of a steel head. However, the center of gravity for these clubs is very high, around 0.9 inch, which may give them a poor sensation and a low rate of backspin, resulting in a loss of control.

Other heads have a two-part structure made of metals with different densities. Generally, that structure is based on a striking face made of a lightweight material such as aluminum or titanium, and a body portion made of a heavy material such as steel, for example. Therefore, substantial values of inertia (Iy) have been measured between 270 and 330 Kg.mm$^2$ due to the fact that mass located in the zone of impact has been distributed at the periphery of the club head. The performance of this type of clubs also suffers if the center of gravity is not properly positioned both vertically, with the known negative influence on the sensation upon impact and the backspin rate, and horizontally, which leads to a tendency to a slice deviation of the ball due to the gear effect caused on the ball.

U.S. Pat. No. 5,429,353 relates to a set of cavity back iron clubs whose perimeter portion surrounding the cavity has a depth that varies with respect to the end of the cavity whose surface is planar and parallel to the surface, such that the position of the center of gravity coincides with the geometrical center of each head. It is considered that the geometrical center is the point located substantially at a distance that is equal to the radius of a golf ball measured from the center point along the sole. This corresponds to a distance of approximately 0.8–0.9 inch (about 2.0–2.3 cm) of the center point of the sole.

U.S. Pat. No. 5,094,457 relates to a golf club whose rotational inertia about the axis of the shaft is lowered by displacing the center of gravity in the direction of the axis of the shaft, and by bringing it closer to the sole of the head, the goal being to facilitate the rapid rotation about the axis of the shaft "Is" before the impact in order to render the face of impact perpendicular to the plane of the swing. If one considers the formula Is =ly +md$^2$ (d being the distance of the center of gravity with respect to the axis of the shaft), the solution of the prior art consists of minimizing Is by reducing, among others, the preponderant factor, namely d, that evolves to the square. The center of gravity is thus brought too close to the axis of the shaft, at approximately 1.35 inch (or 3.43 cm) from the axis of the shaft. Thus, the center of gravity is offset toward the heel with respect to the center of impact. As a result, there is a decrease in the performance, i.e., in the restitution or initial speed of the ball when stricken at the center of impact.

Furthermore, the U.S. Pat. No. 5,094,457 is silent regarding the necessity of maximizing the inertia around the vertical axis passing through the center of gravity. Besides, it is likely that by seeking to reduce Is as much as possible, substantial values of ly cannot be achieved.

As shown in FIGS. 9B, 10A–10C of this prior art document, the iron head is of the blade-type, i.e., it does not have any rear cavity making it possible to obtain a satisfactory inertia about the axis Iy. More specifically, the head has a blade-shaped upper portion with a substantially constant thickness that is connected to a thick lower portion where the mass is concentrated.

Such a construction has the same general disadvantages as those reported for the blade-type irons.

SUMMARY OF THE INVENTION

In view of this state of the art and the noted disadvantages, the present invention has an enlarged club head, to optimize the distribution of mass on an iron head, more particularly by adjusting the position of the center of gravity so as to avoid the drawbacks of the prior art, while maintaining a moment of inertia around ly that is sufficient to stabilize the club upon impact, even in the case of an off-centered stroke.

The invention may also result in a significant increase because the center of gravity is located beneath the geometrical center of the face.

To this end, the invention concerns an iron golf club head including a heel area, a toe area, a striking surface extending between the toe area and the heel area, a sole that rests on a ground plane when the head is placed at address, and a rear surface, the rear surface being provided with a cavity that is open rearwardly and surrounded by a peripheral edge. The preferred club has a heel area having an opening for axis I–I' located in the heel area for the introduction of a shaft. The head has preferably a center of gravity located beneath a horizontal plane whose height with respect to the sole plane is on the order of 18.3 mm (about 0.72 inch). Furthermore, the preferred club head also has an inertia around the vertical axis passing through the center of gravity of the upper body greater than or equal to 230 kg.mm$^2$. In a preferred construction, the club head includes a body made of titanium or of titanium alloy, and at least one additional mass with a greater density than the density of the body and the peripheral edge includes a lower portion extending beneath the cavity, and from the heel area to the toe area, the additional mass(es) being at least a part of the lower portion.

The choice of a body made of a material such as titanium or titanium alloy having a low density and precisely localized additional masses having a higher density, makes it possible to adjust the fundamental parameters, i.e., the position of the center of gravity and the inertia to avoid the disadvantages of the prior art.

According to another characteristic of the invention, the center of gravity is located at a distance from the axis I–I', that is between 35 mm and 40 mm. In this way, the center of gravity is not too far from the heel, which could otherwise lead to a reduction of the initial speed of the ball. One also avoids having too great of an offset of the center of gravity at the toe so as to avoid a tendency of the ball to deviate to the right, as a result of the gear effect.

According to another characteristic of the invention, the additional mass represents 25–70% of the total mass of the head, the remainder being represented by the body made of low density material, such as titanium or titanium alloy. As a result, the additional mass represents a significant portion of the mass to be distributed in the head, which makes it possible to achieve the required characteristics of inertia and of the center of gravity.

BRIEF DESCRIPTION OF THE DRAWINGS

Other characteristics and advantages of the invention will be better understood by means of the description that follows, with reference to the annexed drawings illustrating, by way of non-limiting examples, how the invention is embodied, and in which:

FIG. 12 is a cross-sectional view of FIG. 10 along the line XII—XII;

FIG. 13 is a cross-sectional view of FIG. 10 along the line XIII—XIII;

FIG. 13*a* is a detailed view of FIG. 13;

FIG. 14 is a cross-sectional view of FIG. 10 along the line XIV—XIV;

FIG. 20 is a cross-sectional view of FIG. 19 along XX—XX;

FIG. 21 is a cross-sectional view of FIG. 19 along XXI—XXI;

FIG. 22 is a bottom view of the head of FIG. 19;

FIG. 25 is a perspective exploded rear view showing the particular assembly of a head according to another embodiment of the invention;

FIG. 26 is a transverse cross-sectional view of the head of FIG. 25;

FIG. 27 is an internal view of the additional mass attached to constitute the head of FIG. 25;

FIG. 28 is a perspective rear view of the head of FIG. 25 showing the assembly operation;

DETAILED DESCRIPTION OF THE PREFERRED EMBODIMENTS

Figure 1:
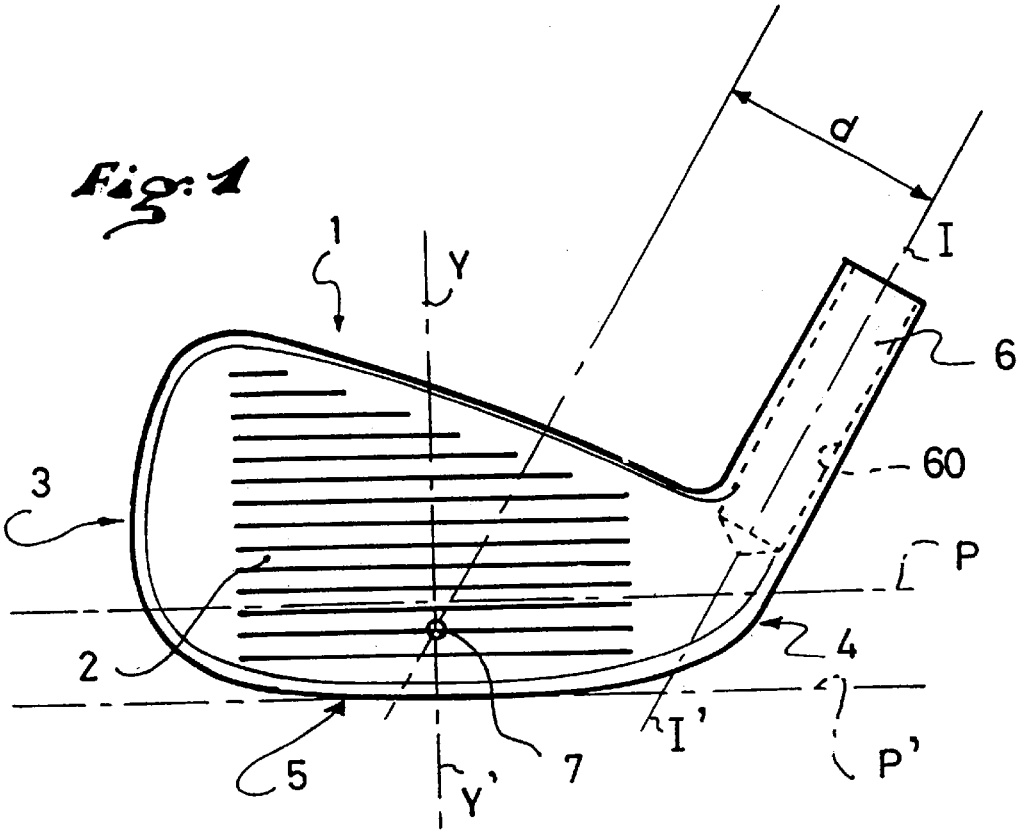
FIG. 1 is a front view of the head according to the invention.

Illustrated in FIG. 1 is an iron head 1 according to the invention that includes a striking surface 2 or front surface edged laterally with a toe area 3 and an opposing heel area 4. A sole 5 is located beneath the surface 2 on which the head rests on the ground at address.

The heel area 4 is extended upwardly by a hosel 6 crossed by an opening 60 of axis I–I'. The opening 60 serves to receive the end of a shaft (not shown).

The center of gravity is represented by the point 7 identifiable on the surface, but which, in reality, is located behind the surface, on a horizontal line passing through the point 7.

According to the invention, the center of gravity 7 is located beneath the plane P representing the limit of 18.3 mm (about 0.72 inch) with respect to the sole plane P' which it is necessary to respect in order to obtain a satisfactory sensation upon impact comparable to that of a blade-type iron, and a relatively high rate of backspin promoting the control of the ball. By construction, it is preferable that at least 55% of the total head mass is distributed beneath the plane P.

By convention, the sole plane P' is the reference plane, or ground plane, that is determined when the ball is placed at address. The plane P is parallel to P' and is located at 18.3 mm (about 0.72 inch) above the plane P'.

The horizontal position of the center of gravity is also important and must be precisely positioned. A center of gravity located too close to the toe area 3 leads to a phenomenon of deviation to the right of the ball. This results from the gear effect. When the ball is struck at the center of the surface, the surface has a tendency to rotate about the axis I–I' counterclockwise, whereas the ball spins in the reverse direction, which makes it move to the right. Likewise, a center of gravity too close to the axis I–I' is not desired because there is a loss in striking force in view of the tendency of the head to rotate (clockwise), and therefore to retract during the shot.

Thus, it has been noted that the center of gravity must advantageously be positioned at a perpendicular distance d from the axis I–I' that is greater than or equal to 35 mm, and less than or equal to 40 mm, and preferably between 35 and 38 mm.

By convention, the perpendicular distance d is the distance that is measured between the axis I–I' and a plane passing through the center of gravity and parallel to the axis I–I' and normal to a front plane.

It is also important to determine the position of the center of gravity 7 behind the striking surface 2, and such position influences the trajectory of the ball. Preferably, the center of gravity 7 is located at a distance from the striking surface that is greater than 3 mm. One thus measures the distance separating the center of gravity from the surface 2 with a line passing through the center of gravity and parallel to the sole plane. Unlike the prior art which arranges the center of gravity as close as possible to the surface, it is recommended here to respect a certain deviation to maintain a sufficient dynamic loft that is necessary to lift the ball and avoid any problem of lateral dispersion of the trajectory.

It must be noted that the position of the center of gravity varies in a set of irons of the invention as a function of the loft angle. In particular, a progressive lowering of the position of the center of gravity is noted as a function of an increase in the loft angle.

Figure 2:
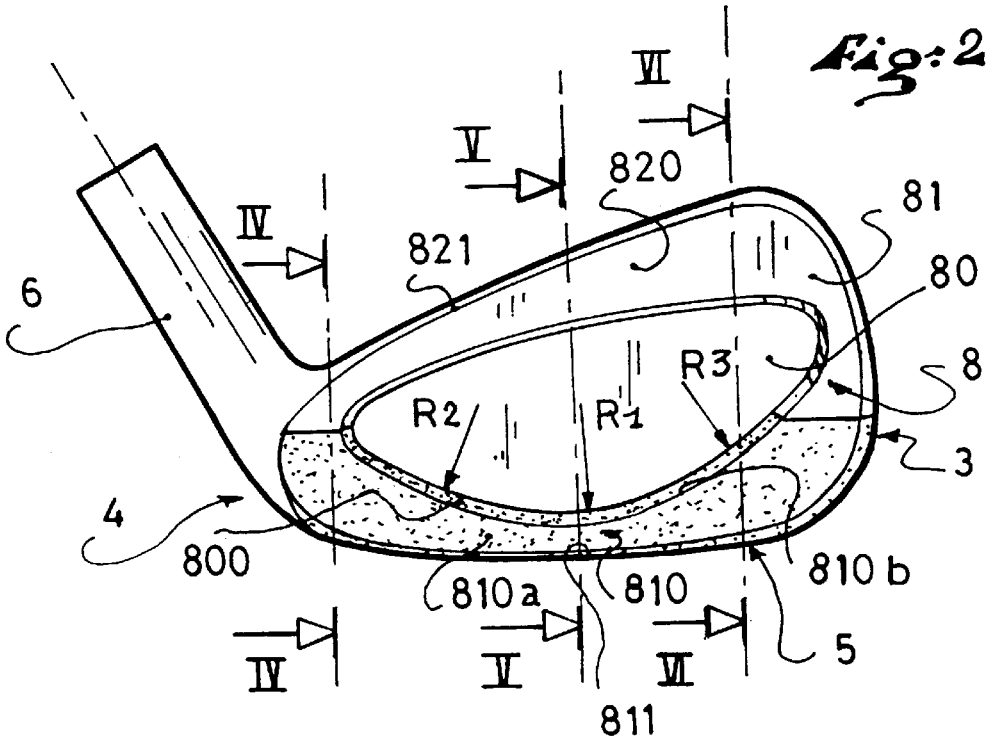
FIG. 2 is a rear view of the head of FIG. 1.
Figure 3:
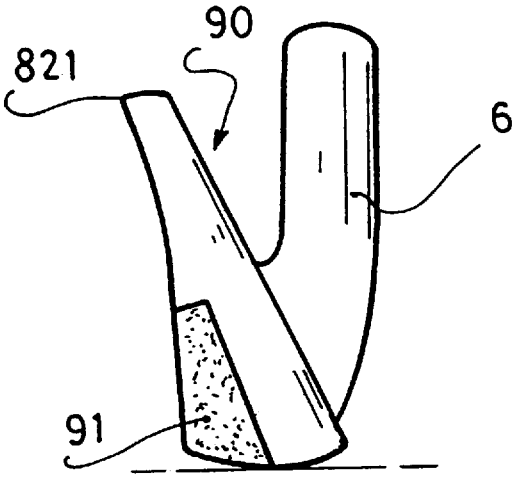
FIG. 3 is a side view of the toe of the head of FIG. 1.

FIG. 2 shows the rear surface 8 of the head that is provided with a central cavity 80, open rearwardly and surrounded by a peripheral edge 81. This edge includes a lower portion 810 that extends horizontally from the heel area 4 to the toe area 3, and that extends vertically from the cavity 80 to the sole 5. The lower portion is continuously connected to an upper portion 820 vertically limited by the open cavity and the upper edge 821 joining the surface.

FIGS. 2–6 show that the head is constituted of a plurality of distinct portions. It includes a body 90 constituting the major portion of the volume of the head and an additional mass 91 with a smaller volume.

The body is made of a metallic material having a low density, i.e., less than 7 g/cm$^3$, but having high mechanical characteristics. The preferred material is titanium or titanium alloy whose density is close to 4.5 g/cm$^3$. The use of a Ti-6AL-4V type alloy whose elastic resistance is on the order of 120,000 psi, or of a Ti-3Al-2.5V whose elastic resistance is on the order of 90.000 psi can be cited, for example.

Other low density metallic material can be used such as, for example, aluminum or aluminum alloy or aluminum matrix composite reinforced with boron carbide, for example (density equal to 2.7 g/cm$^3$).

The additional mass 91 is selected from a high density material, at least greater than 10 g/cm$^3$, and preferably between 12 and 20 g/cm$^3$.

The material can be tungsten (density close to 18 g/cm$^3$) or a mixture of tungsten and copper known by the commercial name "Sparkal"(density close to 15 g/cm$^3$).

Preferably, the insert made of a sintered metal created from a mixture of metallic powders having various densities produces an insert having a predetermined density corresponding to the proportions of the materials present in the mixture. The utilization of masses made of a tungsten alloy-base sintered metal is particularly described in U.S. Pat. No. 3,955,820 (COCHRAN). The manufacturing method, which is known in the manufacture of sintered products with a basis of tungsten, copper, steel or other metallic material, includes a step during which metallic powders of various densities are mixed. Then, a second step consists of pressing the mixture in a mold having the general shape of the mass to be obtained, but having a volume of about 20% greater than the final volume of the mass to be obtained. The pressing continues until a compact mixture commonly referred to as a "green compact" is obtained. The dimensions of the mold are made by a mere homothetic enlargement. The product is therefore agglomerated but remains brittle.

The next step includes a sintering phase and consists of heating to about 2000° F, without pressure and in a furnace, the compact mixture formed during the previous step. The volume of the mixture decreases of about 20% with respect to the initial volume after compaction. The porosities are eliminated by the effect of the temperature and the mixture becomes more resistance and denser. Finally, a conventional sanding operation is applied. The final product obtained reaches about 100% of the theoretical density based upon the weight mixture of the materials which it contains. In other words, from two materials with an initial mass M1 and M2, respectively, and a density d1 and d2, respectively, for example, the density or theoretical density dT of the sintered mixture can easily be calculated using the following formula:

$$dT=d1\cdot(M1/(M1+M2))+d2\cdot(M2/(M1+M2))$$

The desired final volume Vf of the additional mass is obtained by the formula:

$$Vf=(M1+M2)/\mathrm{dT}$$

Of course, these formula can be easily generalized for n materials.

According to the currently known preferred embodiment of the additional mass, the desired density dT is about 12. It is obtained from a mixture of 50% by weight of tungsten, 50% of copper or bronze and traces of nickel and/or tin and/or beryllium (to improve the corrosion resistance).

According to the invention, the additional mass must represent 25–70% of the total head mass, and preferably between 30 and 50% of the total mass. By way of example, for a head with a total mass of 225 g, the additional mass represents approximately 100 g, or 44.5% of the total mass. It must be specified that the total mass of the head is on the average of the commercially available heads. The additional mass is not intended to increase the mass of the head, but rather to redistribute the mass differently to achieve the characteristics of inertia ly and of adjustment of the position of the center of gravity.

Among the commercially available heads known to date, the additional mass generally represents only 15–20% of the total mass, which is insufficient to achieve the desired characteristics.

In a first embodiment shown at FIGS. 1–6, the additional mass 91 is formed of a single attached element with a variable section that extends from the heel area 4 to the toe area 3, and integrally constitutes the lower portion 810 of the peripheral edge 80. The mass thus forms the rear surface 810*a* of the lower portion of the peripheral edge, the segment 800 connecting the end of the cavity 80 to the upper edge 810*b* edging with the rear surface 810*a*, and a portion 50 of the sole 5 extending from the lower edge 810*c* of the rear surface 810*a* toward the striking surface 2.

More specifically, the section of the mass increases progressively from a median area 811 toward the heel area 4 and the toe area 3, respectively. In this manner, a mass distribution toe/sole/heel is promoted which makes it possible to both lower the center of gravity and achieve very substantial values of inertia. It is the substantially curved shape of the lower segment 800 of the cavity that provides the variable form of the additional mass 91. The segment that has a succession of radii of curvature R1, R2, and R3 has at least one radius of curvature R1 in the median area that is less than the radii of curvature R2 and R3 of the end areas at the heel and at the toe of the segment.

Figure 4:
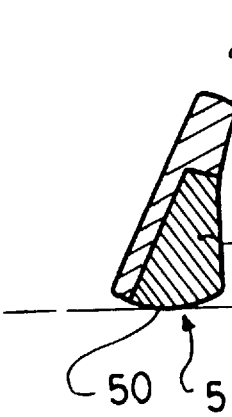
FIG. 4 is a cross sectional view along the line IV—IV of FIG. 2.
Figure 5:
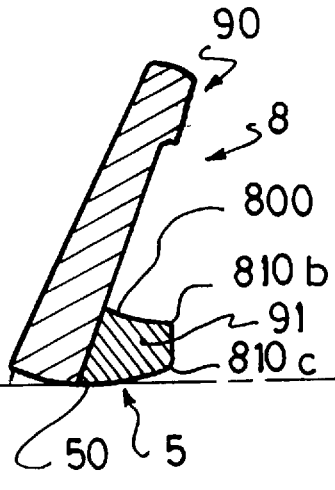
FIG. 5 is a cross sectional view along the line V—V of FIG. 2.
Figure 6:
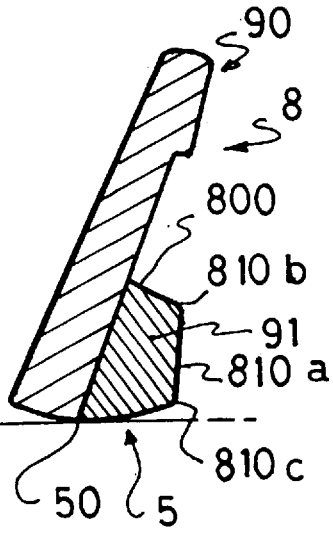
FIG. 6 is a cross sectional view along the line VI—VI of FIG. 2.

FIGS. 4–6 also show that the mass 91 has a form that flares out downwardly or toward the sole 5 in such a way as to further promote the lowering of the center of gravity.

By construction, the example of FIGS. 2–6 leads to obtaining a center of gravity located at a distance generally between 0.660 and 0.680 inch (1.676 and 1.727 cm) from the sole and a moment of inertia "ly" generally between 240 and 255 Kg.mm$^2$.

The moment of inertia "ly" is that measured along the axis y–y' passing through the center of gravity 7 and normal to the ground plane P'.

Figure 7A:
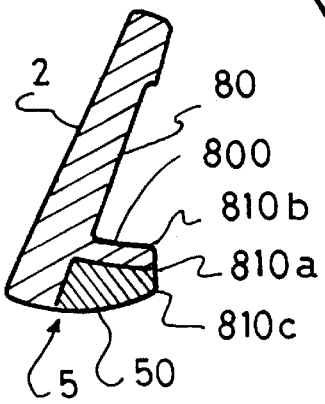
FIG. 7*a* is a cross sectional view along the line VII—VII of FIG. 7.
Figure 7:
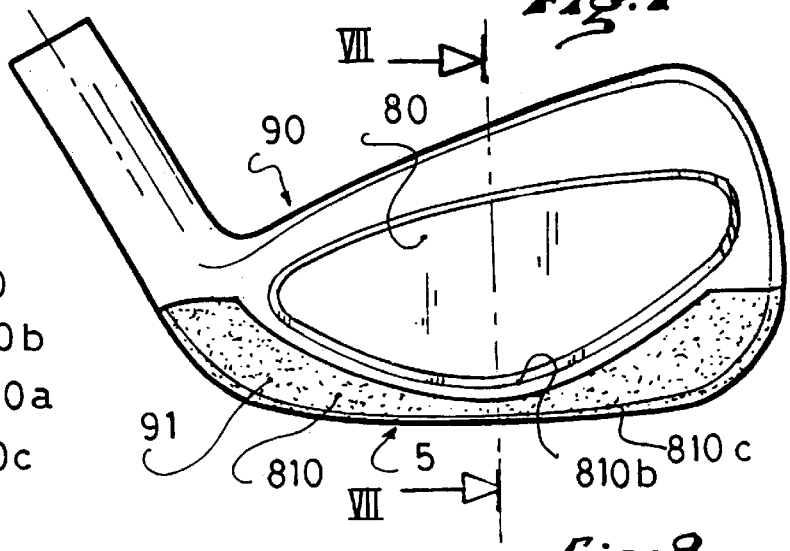
FIG. 7 is a rear view of the head according to a variation of the invention.

FIG. 7 shows a second embodiment where the additional mass 91 only constitutes a portion of the lower portion 810 of the peripheral edge. More particularly, it forms the lower portion of the rear surface 810*a* of the portion 810 that extends downwardly until the lower edge 810*c* or trailing edge, and a portion of the sole 50, from the lower edge 810*c* toward the striking surface 2. In this case, the mass does not constitute a portion of the segment 800 of the cavity. With this construction, it is possible to lower the center of gravity a little further, between 0.640 and 0.680 inch (1.625 and 1.727 cm). The moment of inertia varies from 235 to 250 Kg.mm$^2$.

Figure 8A:
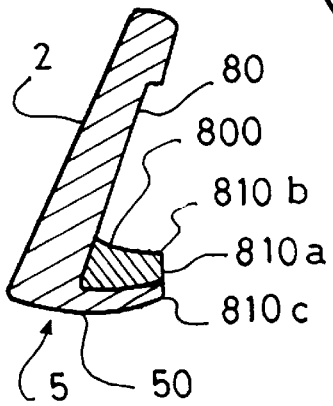
FIG. 8*a* is a cross sectional view along the line VIII—VIII of FIG. 8.
Figure 8:
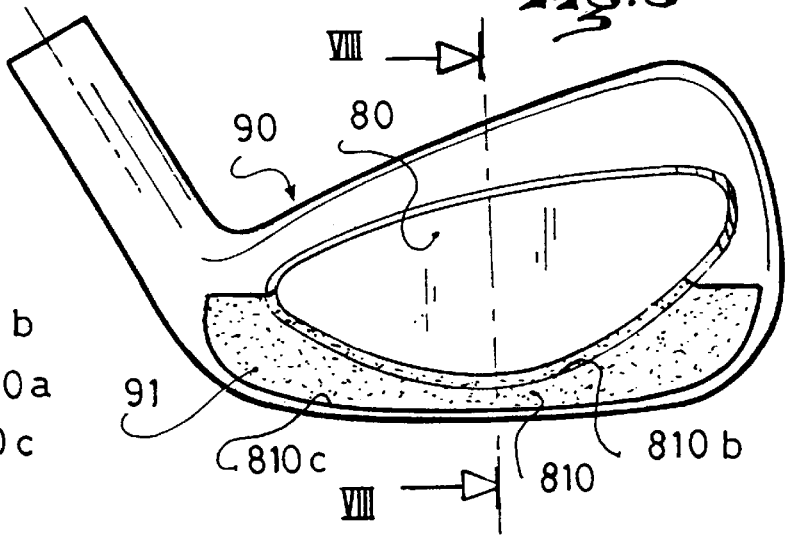
FIG. 8 is a view similar to FIG. 7 according to another variation.

FIG. 8 illustrates another possible embodiment in which the mass forms an upper portion of the rear surface 810*a* of the portion 810 that extends to the upper edge 810*b* and, from the latter, the segment 800 that extends to the end of the cavity 80. In this case, the lower edge or trailing edge 810*c* is still made of titanium or titanium alloy, which has the advantage of offering a better resistance to the abrasion of the sole. Conversely, the position of the center of gravity is located a little higher than in the previous cases, i.e., between 0.675 and 0.700 inch (1.714 and 1.778 cm). The inertia is also lower, on the order of 230–245 Kg.mm$^2$.

Figure 9:
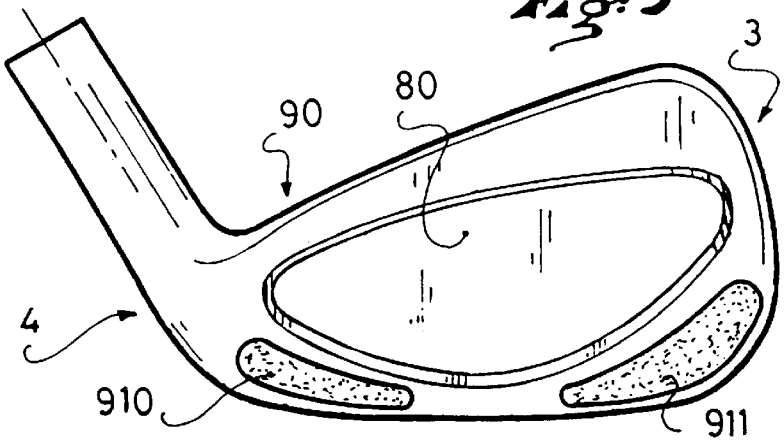
FIG. 9 is a view similar to FIG. 7 according to yet another variation.
Figure 10:
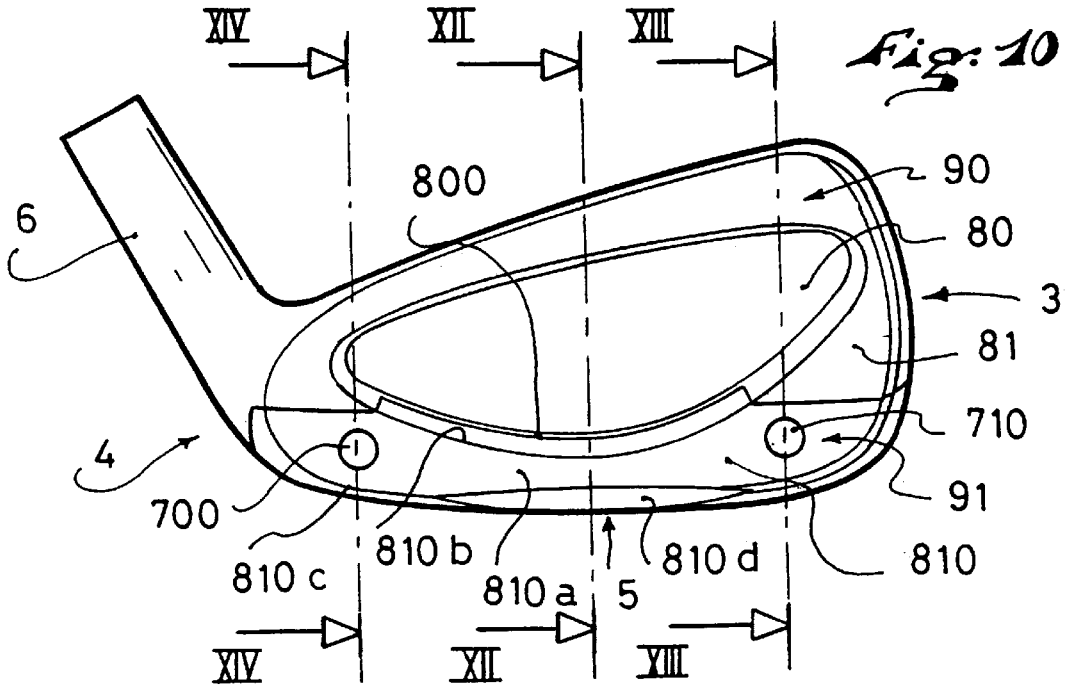
FIG. 10 is a rear view of a head according to a preferred embodiment of the invention.
Figure 11:
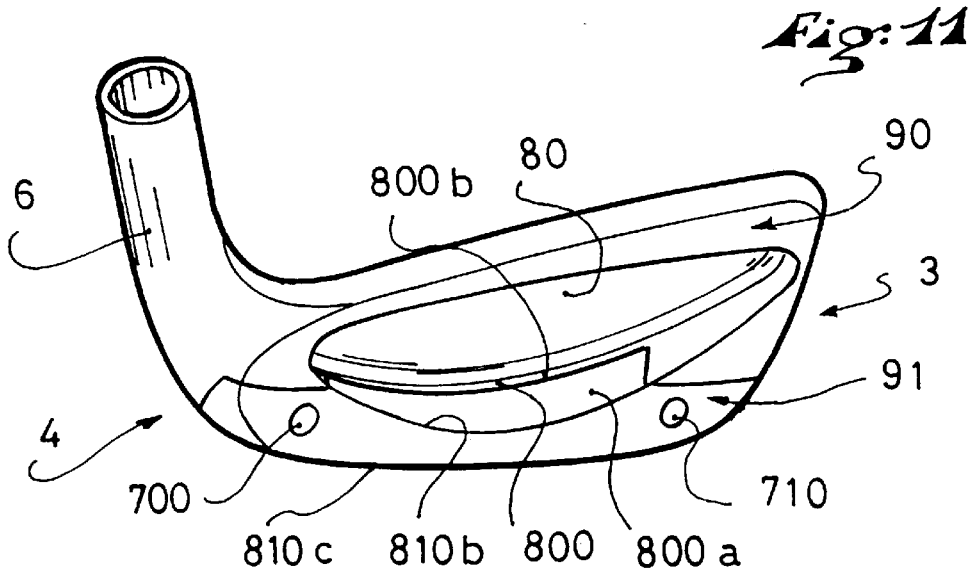
FIG. 11 is a perspective rear view of the head of FIG. 10.

Finally, FIG. 9 shows an embodiment in which the head includes two laterally separated masses 910, 911, the mass center of one being located in the vicinity of the heel area 4, whereas the mass center of the other is located in the vicinity of the toe area 3.

In another embodiment similar to the previous one (but not shown), the head could include a single mass that extends from the heel area to the toe area and that is also insulated both from the cavity and from the sole by thin edges of the body. In short, it means that the masses 910 and 911 joint to form a single mass.

FIGS. 10–17 illustrate a preferred embodiment of the present invention.

The head includes a body 90 made of a low density metallic material, preferably titanium alloy, and an attached insert 91 made of a higher density material forming a weight in the lower portion of the head so as to lower the position of the center of gravity beneath a horizontal plane as previously defined. More specifically, the insert 91 constitutes a part of the lower portion 810 of the peripheral edge 81 surrounding the central cavity 80. It forms, respectively:

- the rear surface 810*a* of the portion 810 which is demarcated by the concave upper ridge 810*b* and by the lower ridge 810*c;*
- at least one portion 50 of the sole 5 extending in the direction of the surface 2 from the lower ridge 810*c;*
- at least one portion of the depth of the concave lower segment 800 connecting the bottom of the cavity 80 to the upper ridge 810*b*.

This position of the insert therefore contributes to reach a position for the center of gravity as low as possible with no disadvantageous effect on the overall shape of the head which remains a cavity-back type of construction, whose main advantage is to increase the sweet spot of the impact surface.

Preferably, the insert includes a central upper portion 800*a* that forms only one portion of the segment 800, but does not extend to the bottom of the cavity 80 so that the insert rests on an edge 800*b* which is a part of the body 90 and thus creates an excess thickness with respect to the face plane. This excess thickness is necessary to enable a sufficient penetration of screws inside the body.

According to a secondary characteristic of the invention, the lower ridge 810*c* of the lower portion 810 of the insert includes a central chamfered zone 810*d*. This results in limiting the friction resistance of the rear portion of the sole, and also in reducing the risk of shock of the ridge against a hard object such as a stone, for example, since sintered material is generally more brittle than a material made by other techniques such as forging, casting, etc. The chamfered zone can extend more or less substantially toward the ends at the toe and at the heel. However, it is preferable not to overly affect the mass in these ends to maintain maximum inertia characteristics.

As mentioned previously, the insert is preferably made of a sintered metal produced by utilizing powder technology. It has been noted that such an insert has a low yield strength, especially when high density materials, such as tungsten, are preferably used in the indicated proportions. In particular, the insert is not very resistant when it is subjected to tensile stresses that occur during the deformation of the head upon impact. Thus, the insert can break beyond a certain yield point.

Therefore, the choice of a method for linking the insert on the body is of primary importance and it influences the resistance of the head upon impact. In particular, the linking arrangement is selected to exert a compression stress on the insert. This pre-stress makes it possible to keep the deformation of the material below the yield strength, when the latter is subjected to tensions during shocks.

As shown in FIGS. 10, 13, 13*a* and 14, the insert is fixed on the body by means of two screws 700, 710 laterally spaced apart. A first screw 700 provided with a shoulder 700*a* is located in the vicinity of the heel area 4. A second screw 710, also provided with a shoulder 710*a*, is located at a distance from the first screw 700 and in the vicinity of the toe area 3.

As shown in more detail in FIG. 13*a*, each screw engages along a first portion through a bore 917 of the insert whose diameter is sufficient to permit a sliding engagement of the screw portion. The second portion or end opposite the shoulder of the screw has a threading which engages into the body by screwing. Of course, the entire shaft portion can be threaded as shown here. The shoulder 710*a* therefore takes support against the edge of the bore of the body and thus exerts a force on the insert which compresses the latter on the body. Preferably, the angle of inclination of the shoulder 710*a* must be greater than 20 degrees with respect to the longitudinal axis of the screw so that a sufficient force is exerted to pre-stress the insert. On the other hand, the angle of inclination must not exceed 40 degrees to limit laterally the size of the shoulder.

Each screw is tightened by means of a head projecting beyond the surface of the peripheral edge which does not appear in the figures and is ground or sanded after the assembly.

It is interesting to note that the insert has a varying section along its entire length to obtain maximum inertia values about the y–y' axis. In particular, the section of the insert tends to increase from the center of mass toward the heel area 4 and the toe area 3, respectively. Preferably, this increase is carried out progressively, and is obtained, in a large part, due to the concave shape of the central portion 800*a* of the insert.

Figure 15:
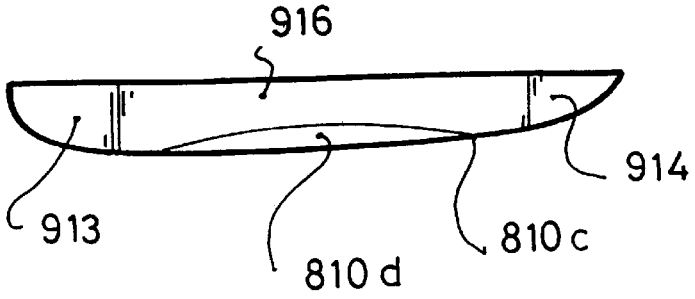
FIG. 15 is an external bottom view of the additional mass of the head of FIG. 10.
Figure 16:
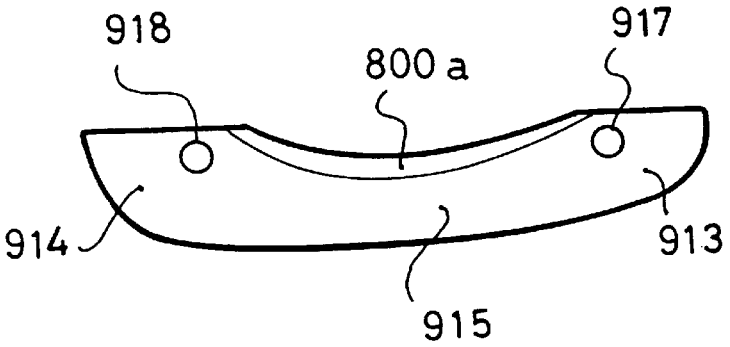
FIG. 16 is an internal view of the additional mass of the head of FIG. 10.
Figure 17:
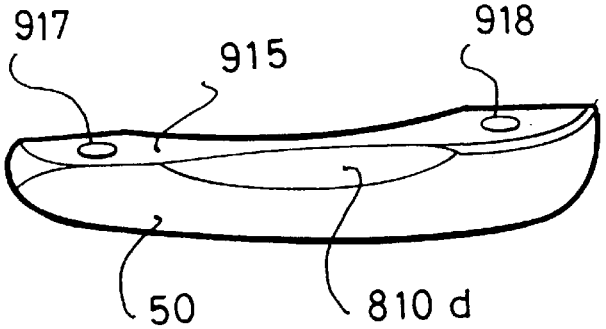
FIG. 17 is a perspective bottom view of the additional mass of the head of FIG. 10.

FIGS. 15–17 show in detail the particular shape of the insert for obtaining the desired physical characteristics. The insert is generally crescent-shaped, with a concave upper central portion 800*a* which forms a portion of the segment 800 of the head when the insert is attached on the body. The concavity in this area contributes to lower the center of gravity to the maximum while maintaining an upper cavity necessary for the maximum enlargement of the sweet spot zone. The insert also has raised lateral portions 913, 914 that surround the central portion 800*a* on both sides and are located at the heel and at the toe, respectively, on the head. Generally, the raised portion 913 located at the toe has a greater section than the raised portion 914 located at the heel, in order to obtain the desired inertia values. The insert is provided with through holes 917, 918 which connect the flanks 915, 916 (visible in FIGS. 12–14) for passage of the screws. The flanks 915, 916 diverge in the direction of the sole portion 50 in order to always promote the lowering of the center of gravity. The internal flank 915 is preferably an adjusted planar surface to facilitate the nesting of the insert in the body housing.

FIGS. 18–22 show a second mode of construction according to the invention.

The body includes a housing 70 that is only provided in the sole 5 and which extends continuously from the toe area to the heel area 4 for receiving the unitary insert 91 whose shape is complementary to that of the housing 70. The insert only occupies a central portion of the width of the sole 5 and is edged on both sides with a front sole edge 51 connected to the striking face 2 and with a rear sole edge 52 connected to the lower portion 810 of the peripheral edge 81 of the body. The insert 91 is generally crescent-shaped, with a concave internal central portion 912 and raised lateral portions at the heel 913 and at the toe 914, respectively, so as to facilitate both a lower position of the center of gravity and a heel/toe distribution of mass that provides a substantial inertia about the y–y' axis. The insert has a substantially V-shaped transverse section, inverted as shown in FIGS. 20 and 21, whose flanks 915, 916 also diverge in the direction of the sole, as described previously, in order to lower the center of gravity of the head to the maximum.

Such an assembly in which the insert 91 is sandwiched between the striking face 2 and the peripheral rear edge 81 of the rear surface 8 has numerous advantages, the main of which is to allow for a homogenous deformation of the assembly upon impact, which increases the resistance of the linkage between the body and the insert. Indeed, since the modulus of elasticity of the constituent materials of the body is much less than the modulus of elasticity of the insert, the body has a tendency to deform further than the insert, when the insert is simply attached to the rear of the body as in the preceding examples. In the sandwich construction of the present embodiment, the deformation occurs more homogeneously, without any risk for the linkage between the two elements.

The junction between the body and the additional mass is obtained by a press-fit of the insert in the housing 70 of the body.

Figure 18:
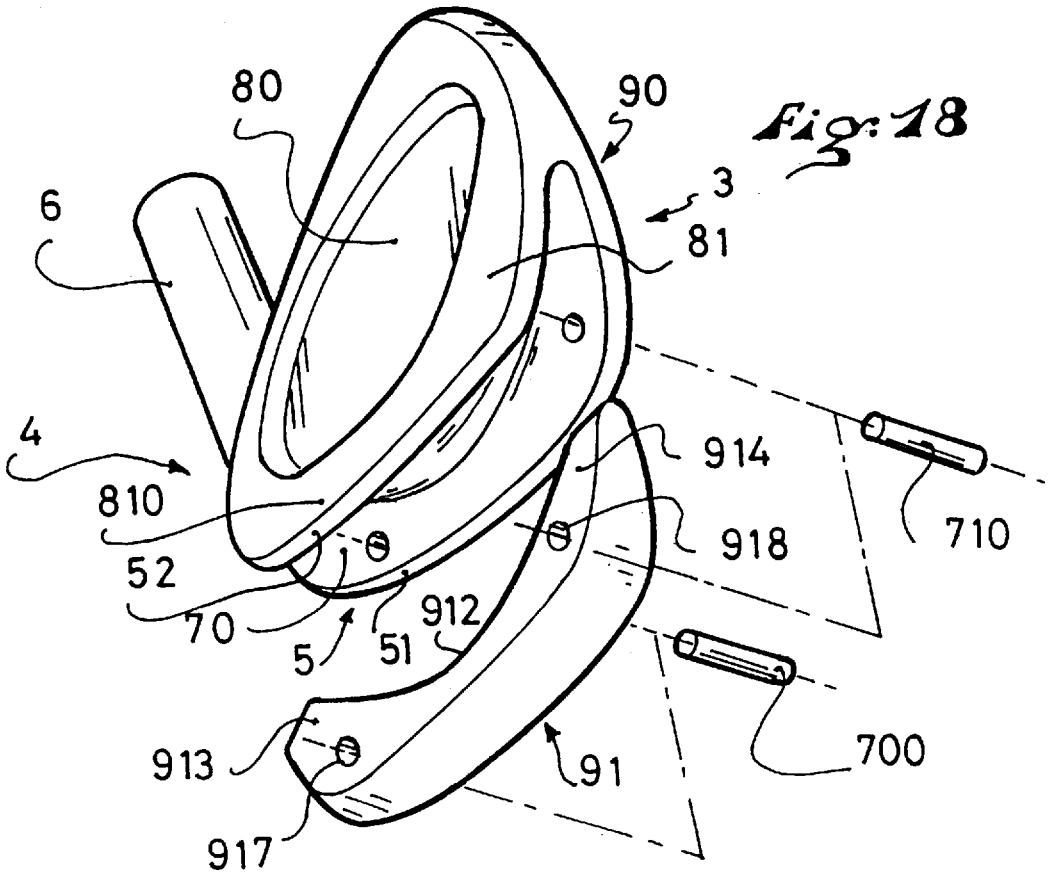
FIG. 18 is a perspective exploded view showing the particular assembly of a head according to a particular embodiment of the invention.
Figure 19:
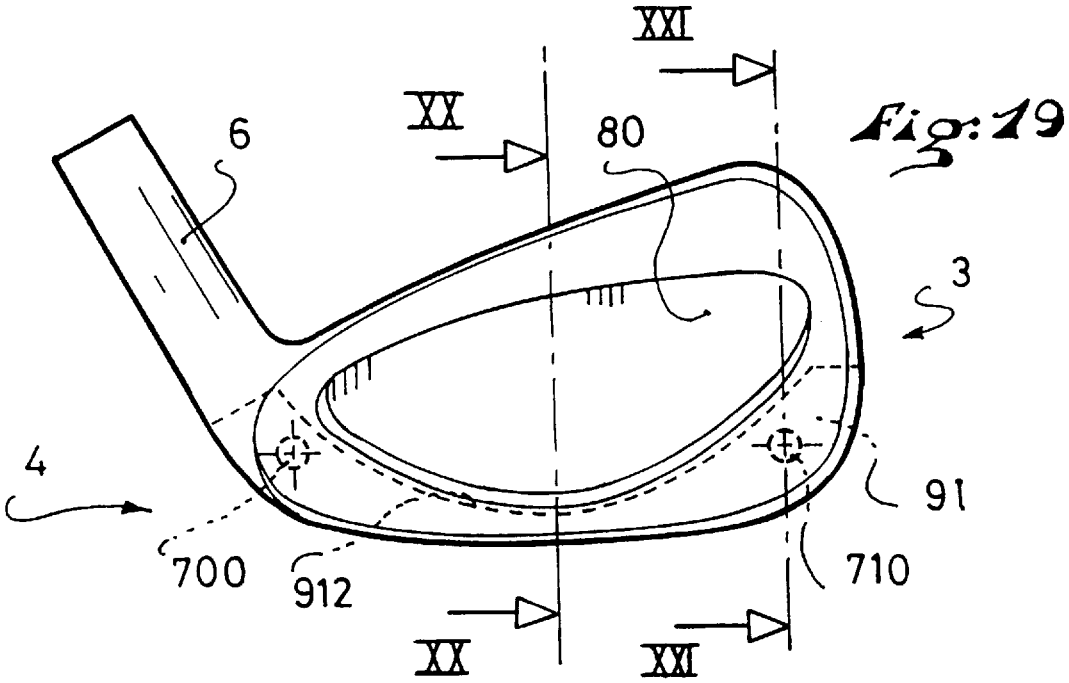
FIG. 19 is a rear view of FIG. 18.

The immobilization is secured by pins, preferably two pins 700, 710 spaced apart, which pass through the body 90 and the insert 91. The insert is provided with through holes 917, 918 which connect the flanks 915, 916. In the example of FIG. 18, the wall of the striking surface 2 is provided with holes that coincide, after assembly of the insert, with the locations of the through holes 917, 918. Each pin 700, 710 is therefore mounted by a press fit through the holes to ensure the fixing of the insert in its housing.

In this particular embodiment, the mounting of the pins from the striking surface side can be preferred because it renders the finishing operation easier. The striking surface which must be perfectly planar is ground and polished in the pin locations by an appropriate finishing tool such as a belt grinding wheel, for example. However, it is also envisioned that the pins can be mounted from the opposite side, i.e., the peripheral rear edge 81 of the rear surface of the body.

Of course, the affixation of the insert in its housing can be obtained by other techniques such gluing with an epoxy-type adhesive, for example. Likewise, the pins can be replaced by screws.

Figure 23:
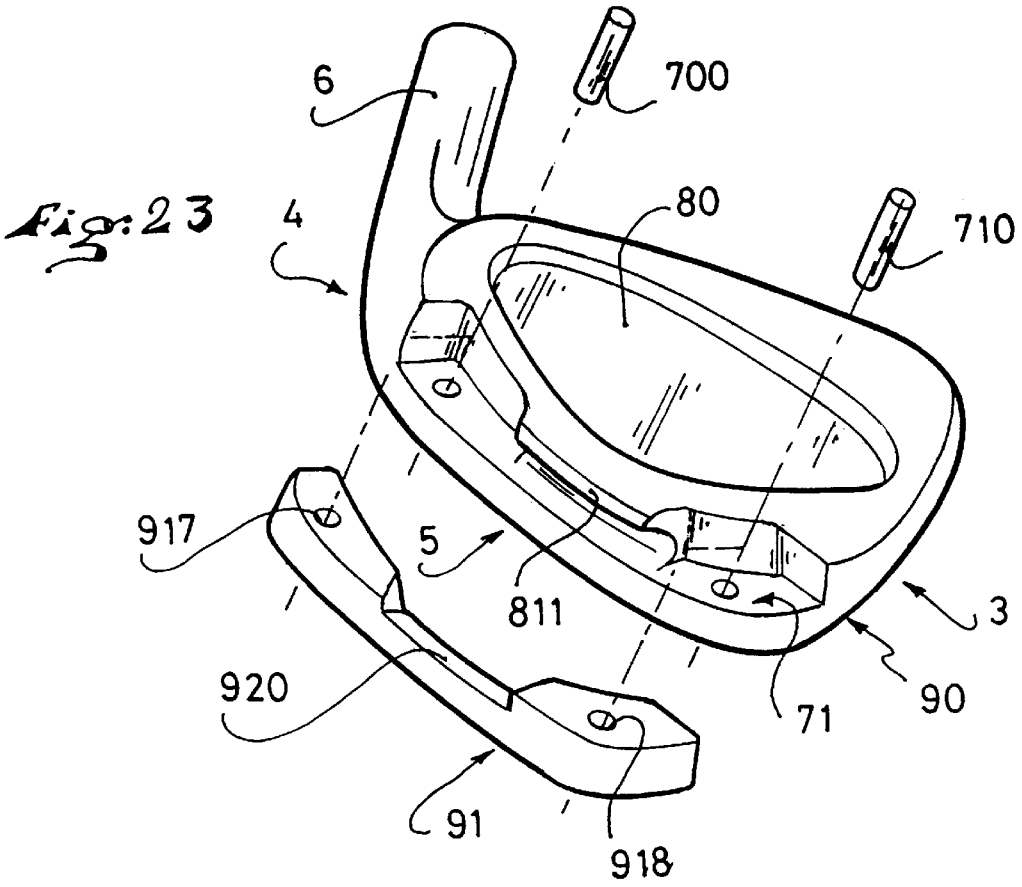
FIG. 23 is a perspective exploded rear view showing the particular assembly of a head according to another embodiment of the invention.
Figure 24:
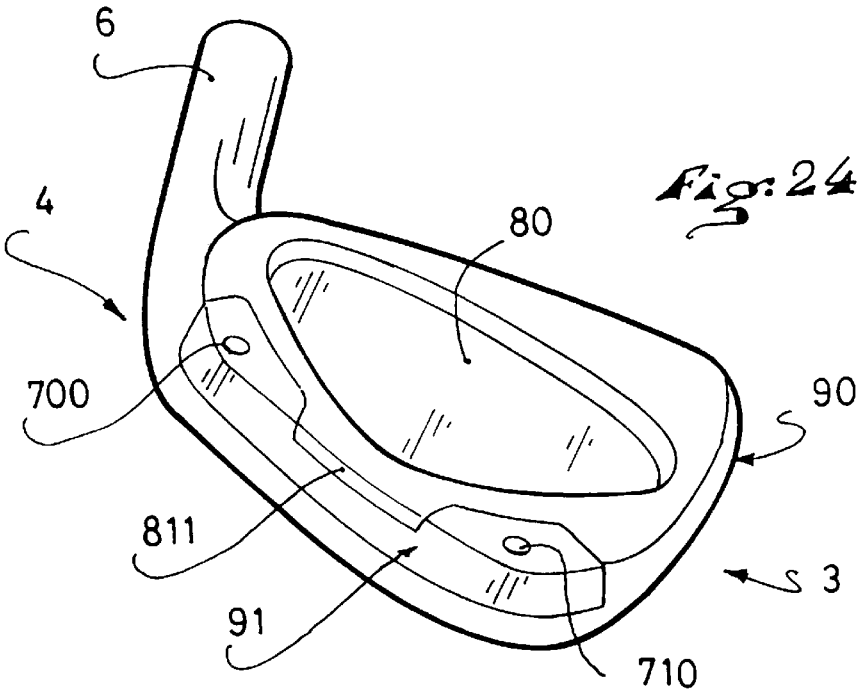
FIG. 24 is a perspective view after assembly of the head of FIG. 23.

FIGS. 23 and 24 illustrate another embodiment similar to the embodiment of FIGS. 18–22. In this case, the body 90 includes a housing 71 transversely demarcated by the wall of the striking surface, on the one hand, and by a rear central edge 811 extending from the edge of the cavity 80 to the sole 5 and on only a portion of the length of the head, on the other hand. In other words, the edge 811 does not extend from the toe to the heel, but remains localized in the central portion of the head.

In the toe area 3 and heel area 4, the housing 71 is open both toward the rear and toward the sole. The insert 91 therefore occupies the space created by the housing thus defined and has a general shape of a crescent with a central notch 920 defining a localized reduction of thickness of the flanks in this area and in which the central edge 811 of the body takes position. The insert is thus sandwiched only in the central portion of the head, i.e., in the area where the deformation upon impact is maximum, so as to render more homogenous the deformation of the assembly formed by the body and the insert. The insert is secured on the body by pins 700, 710 that are force-fitted in holes 917, 918 provided through the insert 91 and are inserted in holes provides through the striking surface. An adhesive can also complete or replace the linkage means formed by the pins.

This construction has the advantage of facilitating the heel/toe mass distribution and of thus increasing the inertia about the y–y' axis, while ensuring a homogenous deformation upon impact and a good resistance of the linkage between the mass and the body.

FIGS. 25–28 show another advantageous embodiment of the invention. In this case, the insert is attached to the back of the body of the head as in the examples of FIGS. 1–6, for example.

The rear surface 8 of the body includes a lower recessed area 72 having a bottom surface 720 and a narrower edge 721 preferably having an acute angle with respect to the bottom surface 720. The bottom surface 720 extends in a substantially parallel or slightly inclined plane with respect to the striking surface 2.

The insert 91 is generally crescent-shaped, with a convex internal portion 912 and raised end portions 913, 914. It includes a planar internal surface 915*a* and lateral edges 915*b* forming an acute angle with the surface 915*a*. The insert is fixed in the recessed area 72 by dovetail-type linkage connection. This connection is formed by projecting tenons or projections 722, 723 affixed to the bottom surface 720, in the one hand, and by mortises 921, 922 formed on the internal surface 915 of the mass adapted to enter into contact with the bottom surface 720, on the other hand. In the example shown, two tenons are provided, one in the vicinity of the toe, and the other in the vicinity of the heel. The mortises are oriented parallel to one another and have openings that are oriented to the engaging side of the linkage connection, i.e., to the side of the concave portion 912.

The insert 91, as well as the tenons 722, 723 are provided with holes that coincide during assembly, and which enable the passage of fixing elements such as pins 700, 710 directed perpendicularly, or substantially perpendicularly to the direction in which the tenons and mortises engage in order to ensure the latching of the insert. Of course, the pins can also be replaced by screws when the insert is made of sintered powders, especially for reasons explained previously.

One must also note the advantageous characteristic that the insert 91 has a distribution of thickness that facilitates the preferred distribution of mass in the heel and toe of the head. Thus, the thickness e of the insert 91 is lower at the center than in the toe area 3 and in heel area 4, and more specifically, the thickness increases progressively from the center toward the raised portions 913, 914.

FIGS. 25 and 28 illustrate the mode of engagement of the insert 91 into the recess area 72 of the body 90. This mode of engagement is carried out in a direction of the sole, substantially toward the upper ridge 821 of the head (arrow A) until the edge 915*b* of the mass is in abutment against the edge 721 of the recess area 72. It is to be understood that the fixing elements constituted by the pins 700, 710 must be oriented transversely with respect to the direction of engagement.

Figure 29:
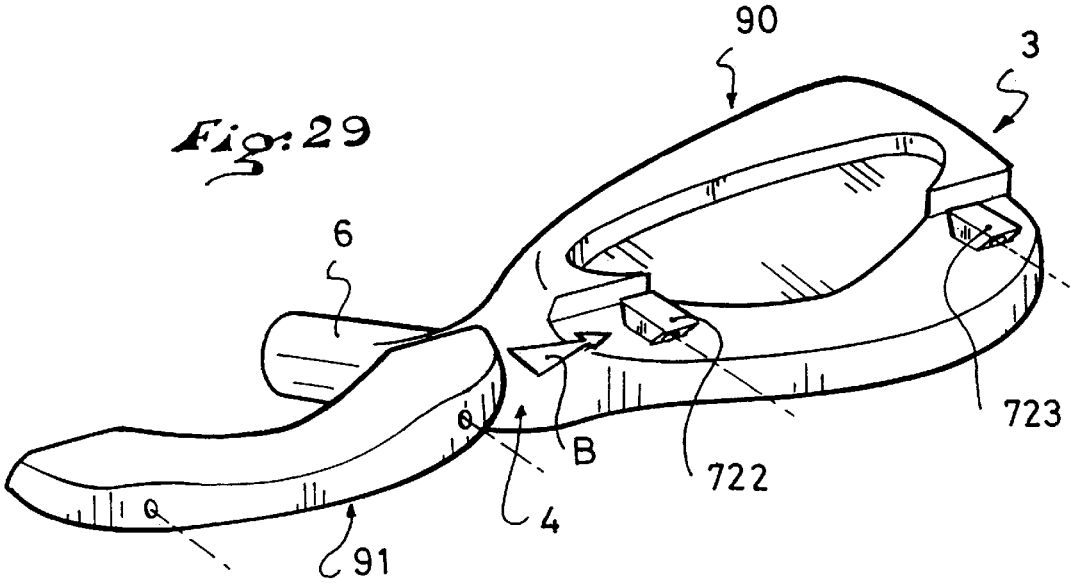
FIG. 29 is a perspective exploded rear view showing the particular assembly of a head according to a variation of the head of FIG. 25.
Figure 30:
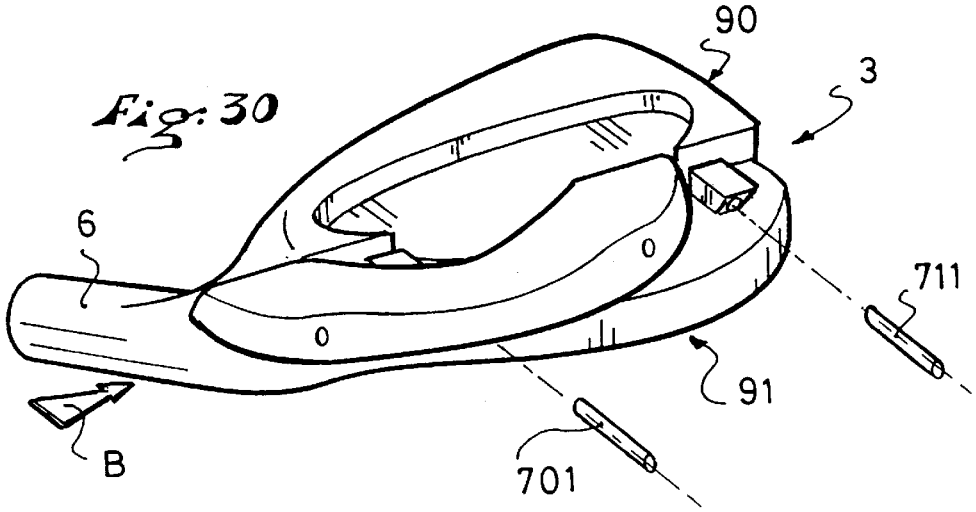
FIG. 30 shows the operation for assembling the head of FIG. 29.
Figure 31:
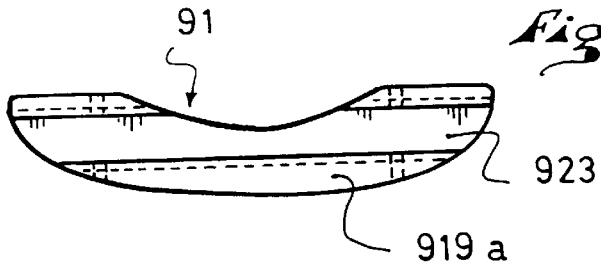
FIG. 31 is a view of the internal surface of the additional mass attached to constitute the head of FIG. 29.

FIGS. 29–31 illustrate an embodiment that is only a possible variation of the preceding embodiment in which the linkage of the insert and head is arranged such that the mode of engagement can be carried out in a direction from the heel area 4 toward the toe area 3 (arrow B). The only difference with respect to the previous embodiment originates from the orientation of the dovetail-type connection and of the fixing elements. In this case, the tenons/pegs 722, 723 cooperate with a single mortise 923 which extends along the entire length of the internal surface 919*a* of the insert. After the assembly, the immobilization of the insert can be carried out by means of pins 701, 711 oriented transversely with respect to the orientation of the mortise 923.

As in the preceding embodiments, the immobilization can be ensured by an adhesive or by screws which then replace the pins.

The affixation of the additional masses to the body can be obtained by various techniques such as co-molding, soldering, tight adjustment, adhesion, etc.

Although the preferred embodiments have been described in detail hereinabove, certain modifications may be envisioned for the one skilled in the art, without leaving the scope of the invention that is covered in the claims that follow.

Figure 32:
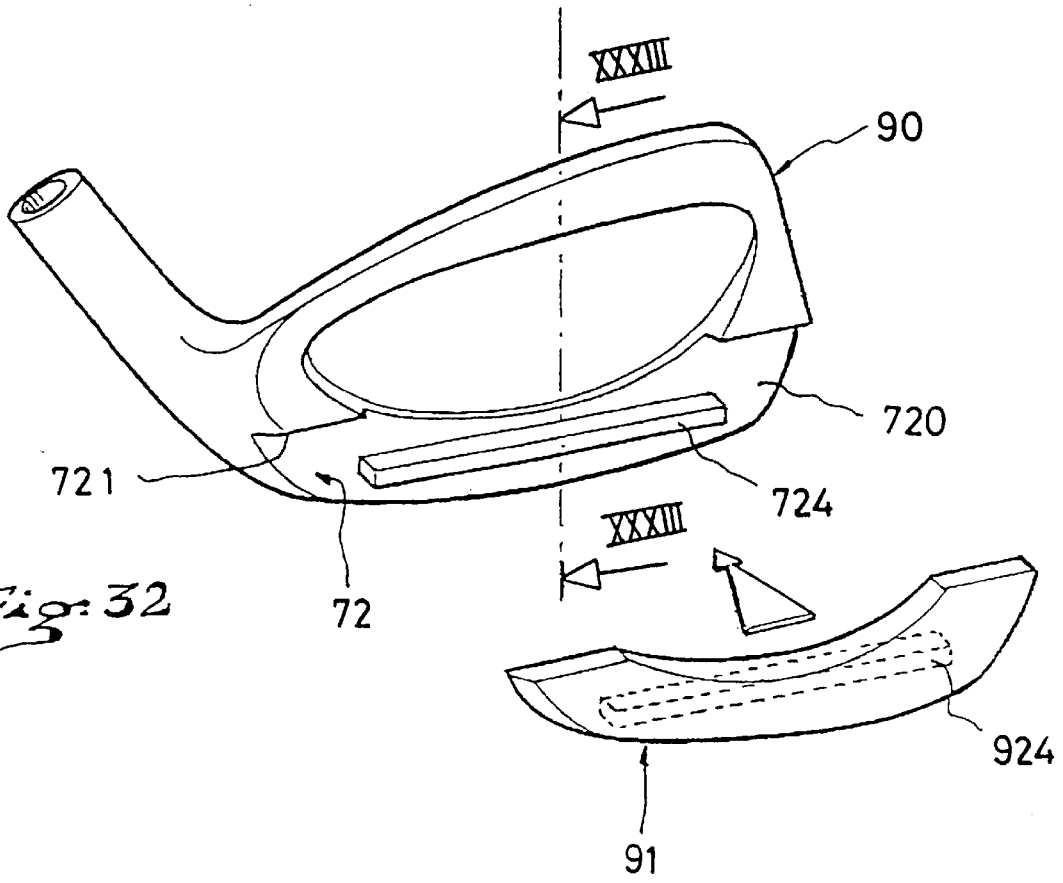
FIG. 32 is a perspective exploded rear view showing assembly of a head according to another embodiment of the invention.
Figure 33:
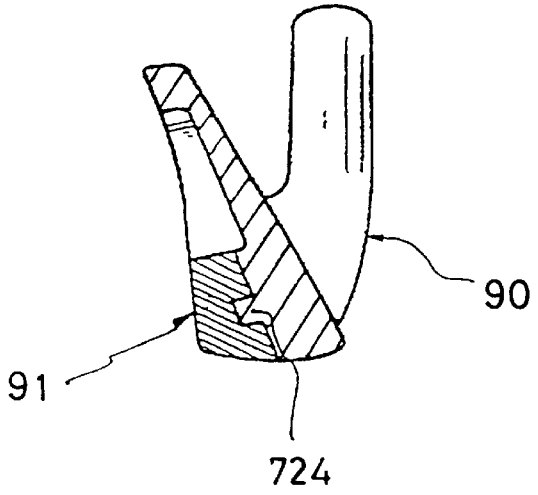
FIG. 33 is a cross-sectional view along the line XXXIII—XXXIII of FIG. 32 showing the particular assembly of a head according to the embodiment of FIG. 32.

FIG. 32 shows an embodiment of the invention. The rear surface includes a lower recessed area 72 having a bottom surface 720 and a narrower edge 721 as previously described. In addition, an elongated rib 724 having extends in toe/heel direction along a substantial portion of the bottom surface to fit precisely into a complementary shaped groove 924 that extends along a substantial part of the length of the internal surface of the insert. The insert is thus mainly secured by press-fit in the recessed area. The rib also has a stiffening effect on the lower thinner part of the sticking face and participates to reduce the stresses which tend to separate the body from the insert at impact. As in the previous embodiments, pins or screws can also be added to secure further the assembly.

What is claimed is:

1. An iron golf club head including a heel area, a toe area, a striking surface extending between the toe area and the heel area, a sole that rests on a ground plane when the head is placed at address, and a rear surface, said rear surface being provided with a cavity that is open rearwardly and surrounded by a peripheral edge, said club head comprising:

a body made of a low density metallic material and an attached insert made of material of higher density than the density of the body material;

said peripheral edge comprising a lower portion extending vertically beneath the cavity and extending horizontally from the toe area to the heel area;

said insert occupying at least one part of the lower portion and having a generally crescent shape, with a concave upper central portion and raised lateral portions at the heel and at the toe, respectively.

2. An iron golf club head according to claim 1, wherein said insert is metallic and constitutes a part of the lower portion of the peripheral edge by forming:

the rear surface of said portion, which is demarcated by a concave upper ridge and a lower ridge;

at least one portion of the sole extending in the direction of the surface from the lower ridge;

at least one portion of the depth of the concave lower segment connecting the bottom of the cavity to the upper ridge.

3. An iron golf club head according to claim 1, wherein the insert is made of a sintered metallic material and is connected by a linkage which exerts a compression pre-stress on the insert.

4. An iron golf club head according to claim 3, wherein the insert is fixed by a screw provided with a shoulder, located in the vicinity of the toe area, and another screw provided with a shoulder, located at a distance from the first and in the vicinity of the heel area, each screw engaging along a first portion in a bore of the insert whose diameter is sufficient to permit a sliding engagement, and engaging into the body along a second threaded portion to permit a screw-threaded engagement.

5. An iron golf club head according to claim 3, wherein the sintered material constituting the insert comprises a mixture of metal powders of various densities.

6. An iron golf club head according to claim 5, wherein the sintered material is essentially a tungsten- and copper-base alloy.

7. An iron golf club head including a heel area, a toe area, a striking surface extending between the heel area and the toe area, a sole and a rear surface, said rear surface being provided with a rearwardly open cavity surrounded by a rearwardly projecting peripheral edge, said club head comprising:

a body made of a low density metallic material and an attached insert made of material of higher density than the density of the body material;

said peripheral edge comprising a lower portion extending vertically beneath the cavity and extending horizontally from the toe area to the heel area;

said insert is metallic and constitutes a part of the lower portion of the peripheral edge by forming:

a rear surface of said lower portion, which is demarcated by a concave upper ridge and a lower ridge;

at least one portion of the sole extending in the direction of the surface from the lower ridge;

at least one portion of the depth of the concave lower segment connecting the bottom of the cavity to the upper ridge.

8. An iron golf club head according to claim 7, wherein the lower ridge of the lower portion of the peripheral edge includes a central chamfered zone.

9. An iron golf club head according to claim 7, wherein the insert is made of a sintered material and is connected by a linkage which exerts a compression pre-stress on the insert.

10. An iron golf club head according to claim 9, wherein the insert is fixed by a screw provided with a shoulder, located in the vicinity of the toe area, and another screw provided with a shoulder, located at a distance from the first screw and in the vicinity of the heel area, each screw engaging along a first portion in a bore of the insert whose diameter is sufficient to permit a sliding engagement, and engaging into the body along a second threaded portion to permit a screw-threaded engagement.

11. An iron golf club head according to claim 9, wherein the sintered material constituting the insert comprises a mixture of metal powders of various densities.

12. An iron golf club head according to claim 11, wherein the sintered material is essentially a tungsten- and copper-base alloy.

13. An iron golf club head comprising a heel area, a toe area, a striking surface extending from the toe area to the heel area, a sole that rests on a ground plane when the head is placed at address, and a rear surface, said rear surface being provided with a rearwardly open cavity surrounded by a peripheral edge, said club head comprising:

a body made of a low density metallic material and at least one insert of higher density than the density of the body;

said body being provided with a housing arranged in the sole and extending continuously from the toe area to the heel area;

said insert occupying said housing and being sandwiched between said striking surface and said peripheral edge.

14. An iron golf club head according to claim 13, wherein the insert is generally crescent-shaped, with a concave internal central portion and raised portions in the heel area and in the toe area.

15. An iron golf club head according to claim 13, wherein the insert has a substantially inverted V-shaped transverse section, having flanks diverging in the direction of the sole.

16. An iron golf club head according to claim 13, wherein the junction between the body and the insert is obtained by a press-fit in the housing.

17. An iron golf club head comprising a heel area, a toe area, a striking surface extending from the toe area to the heel area, a sole that rests on a ground plane when said head is placed at address, and a rear surface, said rear surface being provided with a rearwardly open cavity surrounded by a peripheral edge, said club head comprising:

a body made of a low density metallic material and at least one insert of higher density than the density of the body;

said body comprising a housing occupied by said insert and demarcated by a wall of the striking surface and by a rear central edge extending from the edge of the cavity up to the sole and on only a portion of the length of the club head, said housing being open rearwardly and in the direction of the sole in the toe area and heel area;

said housing having a general crescent shape which comprises a central notch defining a reduction of the thickness of the flanks, in which the rear central edge of the body takes position.

18. An iron golf club head comprising a heel area, a toe area, a striking surface extending from the toe area to the heel area, a sole that rests on a plane when said head is placed at address, and a rear surface, said rear surface being provided with a rearwardly open cavity surrounded by a peripheral edge, said club head comprising:

a body made of a low density metallic material and at least one insert of higher density than the density of the body;

said body comprising a recessed area extending from the toe area to the heel area and beneath the open cavity in the direction of the sole;

said insert occupying said recessed area and being fixed by a dovetail-type linkage.

19. A iron golf club head according to claim 18, wherein the linkage comprises:

tenons projecting in the recessed area and affixed to the body;

at least one mortise formed on an internal surface of the insert;

at least one fixing element oriented transversely with respect to the direction of engagement of the tenons in the mortise.

20. An iron golf club head comprising a heel area, a toe area, a striking surface extending from the toe area to the heel area, a sole that rests on a plane when said head is placed at address, and a rear surface, said rear surface being provided with a rearwardly open cavity surrounded by a peripheral edge, said club head comprising:

a body made of a low density metallic material and at least one insert of higher density than the density of the body;

said body comprising a recessed area extending from the toe area to the heel area and beneath the open cavity in the direction of the sole;

said body comprising an elongated rib which extends in a toe/heel direction and said insert comprising a complementary shaped groove;

said insert occupying said recessed area and being secured by press-fit in said recessed area.

21. An iron golf club head including a heel area, a toe area, a striking surface extending between the toe area and the heel area, a sole that rests on a ground plane when the head is placed at address, and a rear surface, said rear surface being provided with a cavity that is open rearwardly and surrounded by a peripheral edge;

said heel area having an opening for axis I–I' located in the heel area for the introduction of a shaft;

said head having a center of gravity located beneath a horizontal plane parallel to said ground plane, said horizontal plane having a height with respect to the ground plane of about 18.3 mm;

said head having an inertia around the vertical axis y–y' passing through the center of gravity of the upper body greater than or equal to 230 kg.mm$^2$;

said head including a body made of low density material, and at least an additional mass with a greater density than the density of the body;

said peripheral edge including a lower portion extending beneath the cavity, and from the heel area to the toe area; and said additional mass being at least a part of the lower portion.

22. An iron golf club head according to claim 21, wherein said head has a total mass, 55% of said total mass being located beneath said horizontal plane.

23. An iron golf club head according to claim 21, wherein the center of gravity is located at a perpendicular distance from axis I–I' that is greater than or equal to 35 mm, and less than or equal to 40 mm.

24. An iron golf club head according to claim 21, wherein the center of gravity is located at a distance greater than 3 mm from the striking surface.

25. An iron golf club head according to claim 21, wherein the additional mass represents 25–70% of the total mass of the head, the remainder being represented by said body made of titanium or titanium alloy.

26. An iron golf club head according to claim 21, wherein the additional mass is formed as a single attached element with a variable section that extends from the heel area to the toe area.

27. An iron golf club head according to claim 26, wherein the additional mass integrally constitutes the lower portion of the peripheral edge and forms the rear surface of the lower portion of the peripheral edge, the segment connecting the end of the cavity to the upper edge with the rear surface, and a portion of the sole extending from the lower edge of said rear surface toward the striking surface.

28. An iron golf club head according to claim 26,wherein the additional mass only constitutes a portion of the lower portion of the peripheral edge and forms the lower portion of the rear surface of the portion that extends downwardly until the lower edge or trailing edge, and a portion of the sole, from the lower edge toward the striking surface.

29. An iron golf club head according to claim 26, wherein the additional mass only constitutes a portion of the lower portion of the peripheral edge and forms the upper portion of the rear surface of the portion that extends to the upper edge and, from the latter, the segment that extends to the end of the cavity.

30. An iron golf club head according to claim 21, wherein the head includes two laterally separated masses, the mass center of one being located in the vicinity of the heel area, whereas the mass center of the other is located in the vicinity of the toe area.

31. An iron golf club head according to claim 21, wherein the additional mass is selected from a material whose density is greater than or equal to 10 g/cm$^3$.

32. An iron golf club head including a heel area, a toe area, a striking surface extending between the toe area and the heel area, a sole that rests on a ground plane when the head is placed at address, and a rear surface, said rear surface being provided with a cavity that is open rearwardly and surrounded by a peripheral edge;

said heel area having an opening for axis I–I' located in the heel area for the introduction of a shaft;

said head having a center of gravity located beneath a horizontal plane parallel to said ground plane, said horizontal plane having a height with respect to the ground plane about 18.3 mm;

said head including a body made of a lower density material, and at least one additional mass, said additional mass having greater density than the density of said lower density material of said body;

said peripheral edge including a lower portion extending beneath the cavity, and from the heel area to the toe area, said additional mass(es) constituting at least a part of the rear surface of the lower portion, said part having a cross section which increases progressively from a median area toward the heel area and toward the toe area; and said additional mass representing 25–70% of the total mass of said head, the remainder being represented by said body made of said lower density material.

33. An iron golf club head according to claim 32, wherein the body is made of a material whose density is lower than 7 g/cm$^3$.

34. An iron golf club head according to claim 33, wherein said lower density of said body is titanium or titanium alloy.

35. An iron golf club head according to claim 32, wherein said additional mass is formed as a single attached element with a variable section that extends from the heel area to the toe area.

36. An iron golf club head according to claim 32, wherein said additional mass comprises a material whose density is greater than or equal to 10 g/cm$^3$.

37. A set of golf clubs comprising at least two clubs having respective heads with different loft angles, at least each of said two clubs comprising:

a golf club head including a heel area, a toe area, a striking surface extending between the toe area and the heel area, a sole that rests on a ground plane when the head is placed at address, and a rear surface, said rear surface being provided with a cavity that is open rearwardly and surrounded by a peripheral edge;

said heel area having an opening for axis I–I' located in the heel area for the introduction of a shaft;

said head having a center of gravity located beneath a horizontal plane parallel to said ground plane, said horizontal plane having a height with respect to the ground plane of about 18.3 mm;

said head having an inertia around the vertical axis y–y' passing through the center of gravity of the upper body greater than or equal to 230 kg.mm$^2$;

said head including a body made of low density material, and at least an additional mass with a greater density than the density of the body;

said peripheral edge including a lower portion extending beneath the cavity, and from the heel area to the toe area;

said additional mass being at least a part of the lower portion; and the location of the center of gravity being lower as the loft angle increases between at least said two clubs of the set.

* * * * *